US008235318B2

(12) United States Patent
Timm et al.

(10) Patent No.: US 8,235,318 B2
(45) Date of Patent: Aug. 7, 2012

(54) MILL LINER FOR A GRINDING MILL

(75) Inventors: David Timm, Draper, UT (US); Neil Hirschi, Riverton, UT (US); Todd Moir, Powassan (CA); Bob Ecoff, West Valley City, UT (US)

(73) Assignee: Weir Slurry Group, Inc., Madison, WI (US)

( * ) Notice: Subject to any disclaimer, the term of this patent is extended or adjusted under 35 U.S.C. 154(b) by 0 days.

(21) Appl. No.: 12/832,773

(22) Filed: Jul. 8, 2010

(65) Prior Publication Data

US 2011/0073694 A1 Mar. 31, 2011

Related U.S. Application Data

(60) Provisional application No. 61/246,007, filed on Sep. 25, 2009.

(51) Int. Cl.
*B02C 17/22* (2006.01)

(52) U.S. Cl. ..... 241/183; 241/DIG. 30

(58) Field of Classification Search ..... 241/DIG. 30, 241/182, 183
See application file for complete search history.

(56) References Cited

U.S. PATENT DOCUMENTS

| | | | | | |
|---|---|---|---|---|---|
| 4,319,719 | A | * | 3/1982 | Larsen | 241/183 |
| 4,341,355 | A | * | 7/1982 | Hornberger | 241/102 |
| 5,431,351 | A | | 7/1995 | Lejonklou | |
| 5,472,148 | A | * | 12/1995 | Schaeffer | 241/183 |
| 6,036,127 | A | | 3/2000 | Moller | |
| 6,343,756 | B1 | | 2/2002 | Weil | |
| 2008/0265074 | A1 | | 10/2008 | Melo et al. | |

* cited by examiner

*Primary Examiner* — Mark Rosenbaum
(74) *Attorney, Agent, or Firm* — Morris O'Bryant Compagni

(57) ABSTRACT

A mill liner element is structured with an elongated elastomer member having a non-elastomeric backing plate and a plurality of non-elastomeric inserts formed into the elastomer member to provide a liner element that provides a lifter bar element and a wear element that is less prone to cracking compared to conventional all-metal mill lining elements, and which provides ease of handling and replacement when worn. A multiplicity of mill liner elements are positionable in a grinding mill shell, and are suitable for use in a variety of types of grinding mill structures, including ball mills and AG and SAG mills.

3 Claims, 3 Drawing Sheets

MILL LINER FOR A GRINDING MILL

CROSS-REFERENCE TO RELATED APPLICATIONS

This is a non-provisional application that claims priority to provisional application Ser. No. 61/246,007 filed Sep. 25, 2009, the contents of which are incorporated herein in their entirety.

BACKGROUND OF THE INVENTION

1. Field of the Invention

This invention relates to grinding mills, and specifically relates to a mill liner and mill liner assembly for grinding mills.

2. Description of the Related Art

Grinding mills are used in various industries to process hard, solid materials, such as rock and mineral ores, to crush, grind or comminute the material into smaller sizes. Grinding mills can vary in their structural configuration and materials of construction, and in the manner used to crush the solids.

Grinding mills to which the present disclosure is generally directed are comprised of a rotatable drum, also referred to as a shell, having a cylindrical wall and two open ends. In use, material flows in one end and out the other end of the drum. The axis of the drum is most typically horizontal or angled in orientation during operation. The interior of the drum or shell forms a treatment chamber into which the material to be processed is fed. Solid material is fed into the drum, sometimes along with steel balls which are used for aiding the grinding process (e.g., SAG mills), and the drum is rotated. In some processing operations, grinding rods are used instead of steel balls, but the grinding rods are added into the mill separately from the feed.

As the drum rotates, the solid material is lifted up along the inside wall of the drum until the material reaches a point where gravity causes the solid material to fall downwardly to the lowest point of the drum. By this operation, the solid material, along with the steel balls or rods when used, produce a crushing and grinding of the material.

The grinding mill drum or shell is lined with various elements that protect the inner wall of the shell and which are especially designed and positioned within the drum to provide optimal crushing or grinding of the solids. The particular liner elements employed in a grinding mill are specifically determined by and selected in light of the type of solids being processed and the type of crushing or size of crushed material that is desired, as well as other factors such as the size of the mill and the size of the particulate material being fed into the mill.

Liner elements may conventionally include liner plates and lifter bars which are positioned along the inner wall of the drum or shell. Lifter bars assist in lifting the charge (i.e., the solid material being processed) up the side of the shell as the shell rotates. Liner plates, also known and referred to as shell plates or spacers, are used to line the inner wall of the shell, in between the lifter bars, and protect the inner wall of the shell from damage due to abrasion and impact of solid material. The configuration and dimensions of liner plates and lifter bars are selected based on the material being crushed and the type or size of crushing or grinding that is desired.

The liner elements described are most conventionally made of steel or similar material that can withstand the impact of the solid material as it is processed in the rotating drum. Rubber or elastomers have also been used in some liner elements. For example, a mill liner assembly comprising a wear element for positioning between lifter bars in a grinding mill drum is described in U.S. Published Application No. 2008/0265074 A1. The wear element described in that application includes a cushioning plate made partially of elastomeric material that absorbs the impact of the solids material, thereby protecting the shell.

As is well-known in the art of grinding mills, the components of the mill liner eventually crack and/or wear away over time due to the continuous impact of solids against the elements, and replacement of the elements is required. This necessitates that the mill be stopped for a period of time, which causes the cessation of the grinding of material, and may also necessitate the shutting down of other machinery in a plant that operates to further process the material produced by the mill.

In conventional grinding mill configurations that employ steel mill liner components, the process required for replacing broken steel elements is costly, not only because of the operating downtime necessary to replace the broken elements, but also because of the cost of the liner elements. The significant weight of the steel components often requires heavy equipment to move the steel components making repair or replacement difficult and costly. Additionally, broken steel liner elements present dangerous conditions for workers and technicians since the broken pieces of the liner elements are loose and may fall from the wall of the shell endangering human life. The steel liners also present a considerable impact on transport and repair costs due to the weight of the liners.

While the use of elastomer in mill liner elements has resulted in reduced weight of those structures for transport and handling purposes, elastomer liner elements present other limitations, including construction and configuration limitations, and limitations on service life of the liner elements. Additionally, the use of elastomer liner elements in grinding mills has led to the use of lifter bars as a means for anchoring the individual liner plates that are interspaced between the lifter bars about the inner circumference of the rotating drum, a factor which presents additional construction costs in terms of transportation of parts and increased assembly requirements.

It has heretofore been impossible to effectively simplify the assembly and replacement or repair of grinding mills liner elements. Thus, it would be beneficial to overcome the foregoing problems experienced with conventional mill liner assemblies by providing mill liner elements that are more easily handled, more easily installed and replaced, and that result in less operational downtime when being replaced.

BRIEF SUMMARY OF THE INVENTION

In accordance with a first aspect of the present disclosure, a mill liner element is structured with an elongated elastomer member having a non-elastomeric backing plate and a plurality of non-elastomeric inserts that are configured and oriented within the elastomer member to provide a liner element that is less prone to cracking compared to conventional all-metal mill lining elements, and which provides ease of handling and replacement when worn. A multiplicity of mill liner elements are positionable in a grinding mill shell and are suitable for use in a variety of types of grinding mill structures, including ball mills and both AG (autogenous grinding) and SAG (semi-autogenous grinding) mills.

As used herein, the term "elastomer" refers to any type of resilient material which can be formed into the shape of the mill liner element, and can include any of the group of elastomeric materials comprising natural rubber, synthetic rubber, or a polymer, such as polyurethane, or combinations thereof.

The mill liner of this disclosure comprises an elongated elastomer liner member that is generally structured for positioning along the inner wall of a grinding mill drum or shell in the direction of the rotational axis of the drum. The elongated elastomer liner is formed with a base surface that is oriented along the inner wall of a grinding mill drum or shell.

The elongated elastomer liner is configured with a first section that extends a length of the elongated liner member and has a defined height. The elongated elastomer liner is also configured with a second section that extends a length of the elongated liner member, the second section having a height which is greater than the height of the first section. The first section and second section are adjacent to each other along the length of the elongated elastomer member.

A plurality of non-elastomeric inserts is embedded in the elastomeric material of the liner element along the length of the elongated elastomer liner member. The non-elastomeric inserts are generally configured, and are oriented in the elongated elastomer liner member, to provide an outwardly-oriented impact surface that is less than the area of the insert that is oriented perpendicular to the impact surface. The non-elastomeric inserts may be of any suitable configuration, but may, in one embodiment disclosed herein, be formed with a configuration similar to the cross sectional configuration of the elongated elastomer liner member by having a first section and a second section where the height of the second section is greater than the height of the first section.

The plurality of non-elastomeric inserts is positioned in a parallel array adjacent each other along a length of the elongated elastomer liner member. The plurality of inserts may be positioned at an angle perpendicular to the longitudinal axis of the elongated elastomer liner member. Most suitably, however, the plurality of inserts may be positioned at an angle to the longitudinal axis of the elongated elastomer liner member. The non-elastomeric inserts may be made of any suitable material that imparts strength and impact-resistance to the mill liner element, such as steel or other suitably durable materials.

A non-elastomeric base plate member is formed along, and may be embedded in, the base surface of the elongated elastomer liner member. The base plate may be made of any suitably strong material, and may most suitably be made of steel. The base plate is oriented for positioning against the inner wall of the grinding mill drum, and provides stability to the mill liner element and means for securing the mill liner element to the grinding mill drum.

In a second aspect, embodiments are disclosed of a plurality of mill liner elements of the first aspect structured in combination with a grinding mill shell having a continuous cylindrical wall encircling a rotational axis. In this arrangement the mill liner, elements are positioned adjacent each other along the circumferential inner wall of the shell or drum. In one arrangement, each of the mill liner elements is fastened to the wall of the mill shell. As structured, the liner element of the first aspect may replace both the lifter bar and liner plate.

BRIEF DESCRIPTION OF THE SEVERAL VIEWS OF THE DRAWINGS

In the drawings, which illustrates what is currently considered to be the best mode for carrying out the invention.

DETAILED DESCRIPTION OF THE INVENTION

Figure 1:
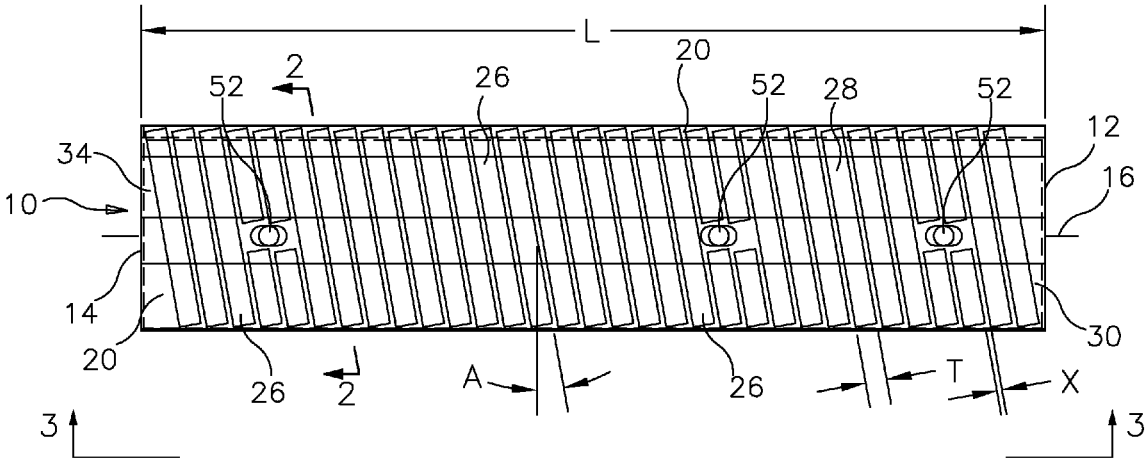
FIG. 1 is a plan view of a mill liner in accordance with one embodiment of the invention.

Referring to the drawings, FIG. 1 illustrates the full length of a mill liner element 10 in accordance with one aspect of the disclosure. The mill liner element 10 has a length L extending between a first end 12 and a second end 14, and a longitudinal axis 16. The longitudinal axis 16 of the mill liner element 10 is conventionally parallel to the axis of rotation of a grinding mill shell or drum (not shown). The dimension of the length L of the mill liner element 10 may, in one conventional form, be sized to extend over the entire length of the grinding mill drum or shell (i.e., as measured in the direction of rotational axis of the grinding mill shell). However, the mill liner element 10 may be sized in length L to be less than the length of the grinding mill shell, such that more than one mill liner element 10 may be placed end-to-end to extend over the length of the grinding mill shell, most commonly with at least two elements in an end-to-end configuration.

Figure 2:
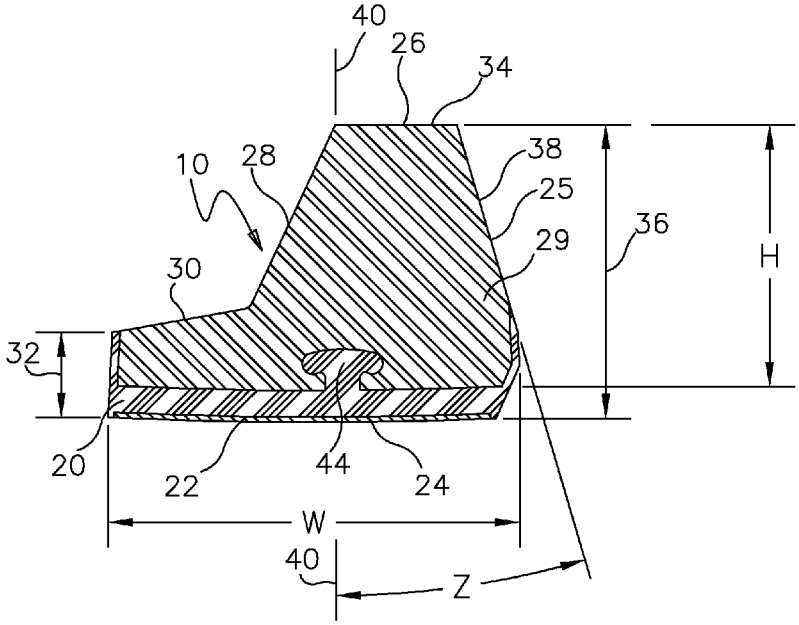
FIG. 2 is a view in cross section of the mill liner shown in FIG. 1 taken at line 2-2.
Figure 4:
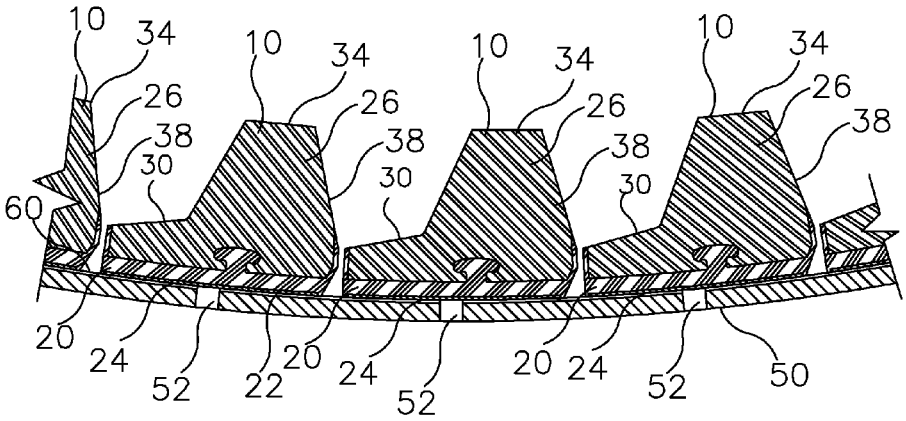
FIG. 4 is a view in cross section of a mill liner assembly illustrating a plurality of mill liners that are shown in FIG. 1, positioned within a mill shell, as shown in FIG. 6, taken at line 4-4 thereof.
Figure 5:
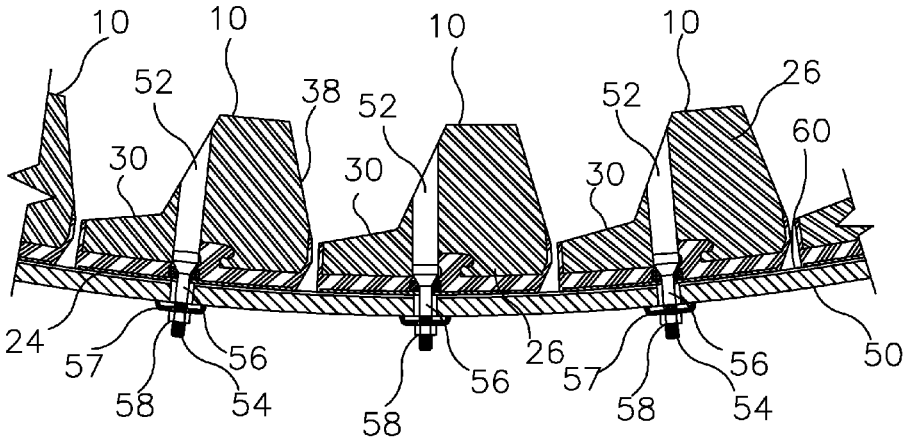
FIG. 5 is a view in cross section of a mill liner assembly illustrating the attachment apparatus of a plurality of mill liner elements positioned within a mill shell as shown in FIG. 6, taken at line 5-5 thereof.

FIG. 2 illustrates the mill liner element 10 in cross section. It can be seen that the mill liner element 10 comprises an elongated elastomer liner member 20 having a width W and a base surface 22 that extends substantially the width of the mill liner element 10 and is oriented for positioning along the inner wall of a grinding mill shell (as shown in FIG. 4 and FIG. 5). A non-elastomeric backing plate member 24 is formed or extends along the base surface 22 of the elongated elastomer liner member 20. The backing plate member 24 may be a single, continuous length of non-elastomeric material that extends substantially the length L of the mill liner element 10 (as shown in phantom line in FIG. 1). Alternatively, the backing plate member 24 may comprise a plurality of lengths of non-elastomeric material that are positioned adjacent each other along the length L of the mill liner. The backing plate member 24 may be made of any suitably strong and durable material, such as stainless steel, steel or alloy.

A plurality of non-elastomeric inserts 26 are embedded in the elongated elastomer liner member 20 in a spaced apart array with elastomeric material positioned between adjacent inserts 26. The plurality of inserts 26 is preferably positioned in parallel and adjacent series along the length L of the mill liner element 10, as shown in FIG. 1. The inserts 26 may be oriented in a direction that is perpendicular to the longitudinal axis 16 of the mill liner element 10. Alternatively, as shown in FIG. 1, the inserts 26 may be oriented at an angle A to the longitudinal axis 16. The angle A may be from about 5 to about 30 angle degrees from a plane that perpendicularly bisects the longitudinal axis 16. Orienting the inserts 26 at an angle to the longitudinal axis 16 has the advantage of preventing "racing," which is a premature wearing of the elastomer in between the inserts 26 caused by the flow of finer grades of solids under the primary volume of the mill charge. Consequently, the service life of the mill liner elements 10 is increased.

As illustrated in FIG. 1, the inserts 26 are spaced apart from each other in series along the length L of the elongated elastomer member 20, thereby providing a width X of elastomer material between adjacent inserts 26. The inserts 26 may be spaced from each other so that the width X between adjacent inserts 26 along the length of the elongated elastomer member 20 is equal. Alternatively, the width X between adjacent inserts 26 may vary down the length L of the elongated elastomer member 20. The width X of the spacing between inserts may be from between about 0.25 inches to about two inches or greater (about 6 mm to about 50 mm or greater). A particularly suitable width X between adjacent inserts 26 may be from about 0.38 inches to about 0.75 inches (about 9 mm to about 19 mm).

The inserts 26 embedded in the elongated elastomer member 20 may be made of any suitable material that is durable and able to withstand the impact of the solids being processed in a grinding mill. One exemplary material is steel. However, other materials may be equally suitable, such as certain ceramics and alloys. In general, each insert 26 is formed as a disk of material having a thickness T, as shown in FIG. 1, which defines an impact edge 28 that is oriented in a direction away from the base surface 22. The thickness T of the inserts may be from about 1.5 inches to about 7.5 inches (from about 38 mm to about 191 mm). It is understood that the thickness T of the insert is selected to provide the greatest durability to the inserts 26 and the overall structure of the mill liner element 10.

The inserts 26 are further configured with opposing, spaced apart surfaces which define the thickness T of the insert 26. One of the opposing surfaces 29 is illustrated in FIG. 2. The opposing surfaces 29 may generally extend in a perpendicular direction relative to the longitudinal axis 16 of the liner element 10 and perpendicular to the impact surface 28 of the insert 26. Each insert also has a defined height H, as illustrated in FIG. 2, where the height H of the insert 26 is greater than the thickness T of the insert 26. The inserts 26 may be formed in any number of varying configurations where the outer perimeter 25 of the disk is of any regular or irregular shape.

The cross sectional configuration of the mill liner element 10 may vary depending on the application in which the grinding mill will be used. The mill liner element 10, however, is generally configured to provide elements of both a shell or liner plate and a lifter bar. Consequently, the elongated elastomer liner member 20, as illustrated in FIG. 2, is generally configured with a first section 30 that extends a length of the elongated liner member 20 and has a height 32. The elongated liner member 20 is also configured with a second section 34 that extends a length of the elongated liner member 20 and has a height 36 which is greater than the height 32 of the first section 30.

The first section 30 of the mill liner element 10 may function as a shell liner or wear element for the grinding mill, while the second section 34 may function as a lifter bar element. Accordingly, the second section 34 is formed with an impact face 38. As shown in FIG. 2, the impact face 38 is formed at an angle Z to a vertical plane 40 extending through the longitudinal axis 16 of the mill liner element 10. The impact face 38 may vary in configuration and angle, however, depending on the process application.

As shown in FIG. 2, the inserts 26 may be configured with an outer perimeter 25 that is similar to or resembles the cross section shape of the elongated elastomer liner member 20, such that the insert 26 is configured with a first section and second section as previously described with respect to the elongated elastomer liner member 20. The outer perimeter shape 25 of the insert 26, however, need not be the same as the cross section shape of the elongated elastomer member 20.

The mill liner element 10 may be formed by various means. For example, a mold may be employed into which the plurality of inserts 26 are positioned and held in place while elastomer material is poured or otherwise introduced, such as by hand laying, into the mold to fill the spaces between the inserts 26. Once the inserts 26 and the elastomer have been positioned into the mold, the contents of the mold are then simultaneously heated and compressed for a period of time to cause the elastomer material to cure. The mill liner element 10 is then removed hot from the mold and allowed to cool. Subsequently the mill liner element 10 is inspected for voids or lack of fill, and excess flashing of elastomeric material is trimmed away. As a result of the molding process, a chemical bond is formed between the inserts 26 and the elastomeric material where these component parts are in contact. This bond provides resistance to separation of the inserts 26 from the body of the mill liner element 10 in use.

In the embodiment described, the inserts 26 are formed with a channel 44, as seen in FIG. 2, into which the elastomer material is introduced, thereby providing a secure attachment of the inserts 26 to the elongated elastomer member 20. Other methods known to those of skill in the art may be employed to form the embedded inserts 26 into an elongated elastomer member 20 to form the mill liner element 10.

Figure 3:
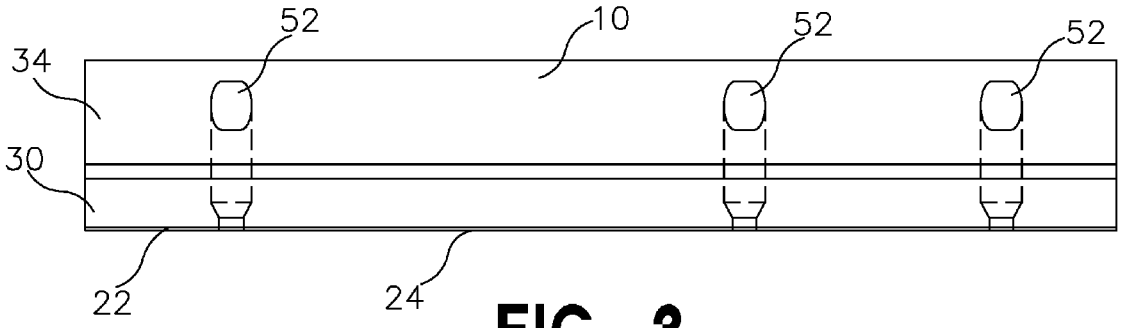
FIG. 3 is a view of the mill liner shown in FIG. 1, taken at line 3-3.

The mill liner element 10 is further formed with means for attaching the mill liner element 10 to a grinding mill shell 50, as illustrated in FIGS. 4 and 5. For example, as shown in FIGS. 1 and 3, a number of channels 52 may be formed through the mill liner element 10 through which fastening apparatus 54 may be positioned, as is shown in FIG. 5. Notably, the channels 52 extend through the backing plate member 24, which provides an anchoring device for the fastening apparatus 54, and into the elastomer material. The fastening apparatus 54 may be any suitable device, such as bolts 56, having associated washers 57 and hex nuts 58.

FIGS. 4 and 5 illustrate the positioning of a plurality of mill liner elements 10 along the inner circumferential wall 60 of a grinding mill shell 50. The mill elements 10 are positioned adjacent to each other about the entire inner wall 60 of the grinding mill shell 50 with the longitudinal axis 16 of each mill liner element 10 being oriented parallel to the rotational axis of the grinding mill shell 50. It can be seen from FIGS. 4 and 5 that the base surface 22, and thus the backing plate 24 of each mill liner element 10, may be curved to conform to the curvature of the mill shell 50.

Figure 6:
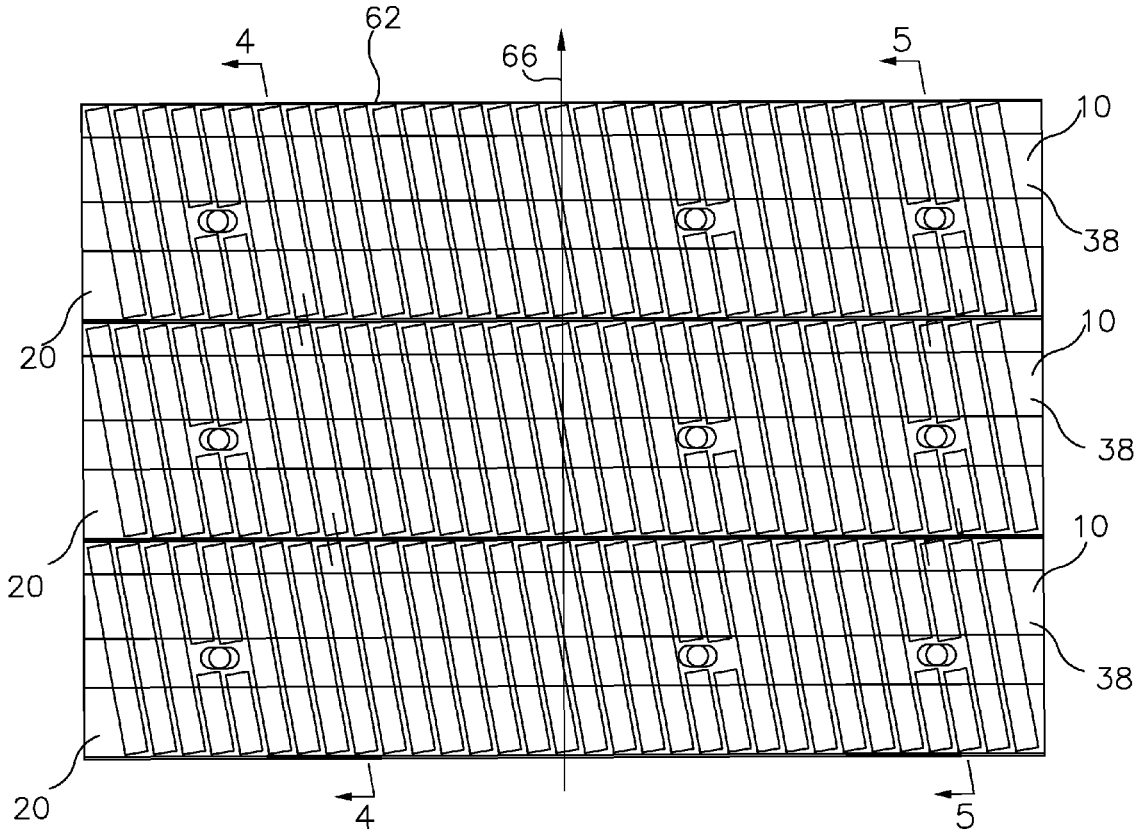
FIG. 6 is a plan view of an exemplar embodiment of a mill liner assembly where a plurality of mill liner elements are positioned adjacent each other in a mill shell.

FIG. 6 shows a plan view of a portion of a grinding mill 62 illustrating three mill liners 10 positioned adjacent to each other. The direction of rotation of the grinding mill shell 50 is illustrated by arrow 66. It may be noted that the mill liners 10 may preferably be placed adjacent to each other so that there is essentially no spacing between adjacent mill liners 10, as shown in FIG. 6. It is also possible, however, to arrange the mill liners 10 in both side-by-side and end-to-end arrangement along the inner wall 60 of the shell 50 so that the mill liners 10 are slightly spaced apart.

The mill liner element design disclosed herein presents particular advantages over conventional mill liners. First, providing a plurality of inserts that are spaced apart and separated by a thickness of an elastomer material reduces the failure rate experienced with all steel mill liners. The elastomer material cushions the inserts to reduce the force of impact on the inserts. Second, if the inserts should crack or break, they are held in place by the surrounding elastomer material, thereby preventing dangerous conditions experienced with broken and falling sections of conventional steel liners. By virtue of their configuration, the mill liners disclosed herein may provide extended service life over conventional steel liners, thereby reducing downtime of the grinding mill and reducing repair costs.

The design of the mill liner element disclosed herein imbues the mill liner element with less weight, thereby reducing transport costs, and making handling of the mill elements considerably easier than conventional steel liners. Moreover, the reduced weight of the mill liners results in extended service life of the grinding mill because less weight and wear is placed on the mill bearings and bull gear. The elastomer material of the mill liner elements also reduces the noise level during operation of the grinding mill, resulting in less damage to the hearing of mill workers.

Further, the design of the mill element also provides a wear element as well as a lifter bar element, thereby eliminating the need for two separate elements as is conventional in the art. Thus, the mill liner provides both a wear element and a lifter bar combination for creating motion and breakage, or comminution, of the solids material being processed in the mill. The arrangement of the inserts across the whole mill liner element means that the integral lifter bar and wear element components are through-strengthened, which is an improvement on the conventional arrangements. The arrangement further simplifies the replacement or repair of the liner elements in the grinding mill drum or shell.

The mill liner element disclosed herein can be adapted in configuration and dimensions to meet the particular needs of any specific application to which a grinding mill may be put in service. Thus, reference herein to specific details of the structure, configuration, size or dimension of the mill liner element, or its constituent parts, is by way of illustration and not by way of limitation.

What is claimed is:

1. A mill liner element, comprising;

an elongated elastomer liner member having a base surface for positioning along the inner wall of a grinding mill shell, said elongated elastomer liner member having a first section that extends a length of the elongated elastomer liner member and has a height, and said elongated elastomer liner member having a second section that extends a length of the elongated elastomer liner member, said second section having a height which is greater than said height of said first section;

a non-elastomeric base plate member positioned along said base surface of said elongated elastomer liner member; and a plurality of non-elastomeric inserts embedded in the elastomer of said elongated elastomer liner member at a non-perpendicular angle to a vertical plane that transects a vertical plane formed along a longitudinal axis of the elongated elastomer liner member bisecting said second section thereof.

2. A mill liner element, comprising;

an elongated elastomer liner member having a base surface for positioning along the inner wall of a grinding mill shell;

a non-elastomeric base plate member positioned along said base surface of said elongated elastomer liner member;

a plurality of non-elastomeric inserts embedded in the elastomer of said elongated elastomer liner member; and wherein, said elongated elastomer liner member has a first section that extends a length of the elongated elastomer liner member and has a height, and said elongated elastomer liner member has a second section that extends a length of the elongated elastomer liner member, said second section having a height which is greater than said height of said first section, and wherein each non-elastomeric insert of said plurality of non-elastomeric inserts further comprises a first section having a height dimension and a second section having a height dimension that is greater than the height dimension of the first section of the non-elastomeric insert, and further wherein each said first section and said second section of each said non-elastomeric insert is embedded within the elastomer material of said elongated elastomer liner member and said first section and said section of each said non-elastomeric insert are oriented to provide an impact edge.

3. The mill liner of claim 2, wherein said impact edge of said first section of each said non-elastomeric insert is oriented substantially parallel to said base surface of said elongated elastomer liner member.

* * * * *